US008807738B2

(12) United States Patent
Jimenez et al.

(10) Patent No.: US 8,807,738 B2
(45) Date of Patent: Aug. 19, 2014

(54) CARRIAGE ACTIVATED PUMP FOR INKJET PRINTER

(75) Inventors: Juan Manuel Jimenez, Escondido, CA (US); Wayne Edward Stiehler, Spencerport, NY (US); Sathiyamoorthy Thirunageswaram Sivanandam, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 207 days.

(21) Appl. No.: 13/430,744

(22) Filed: Mar. 27, 2012

(65) Prior Publication Data

US 2013/0258020 A1 Oct. 3, 2013

(51) Int. Cl.
*B41J 2/01* (2006.01)
*B41J 2/175* (2006.01)

(52) U.S. Cl.
CPC ..... *B41J 2/17596* (2013.01)
USPC ..... 347/104

(58) Field of Classification Search
CPC ..... B41J 2/01; B41J 2/175; B41J 2/17509; B41J 2/17513; B41J 2/1752; B41J 2/17523; B41J 2/17553; B41J 2/17556; B41J 2/17596; B41J 2/2114; B41J 11/0015; B41J 11/0065; B41J 11/007; B41J 11/0085; B41J 11/06; B41J 13/103; B41J 2202/20; B41M 5/52; B41M 7/00
USPC ..... 347/84–86, 101, 104; 400/578
See application file for complete search history.

(56) References Cited

U.S. PATENT DOCUMENTS

| | | | | |
|---|---|---|---|---|
| 6,793,316 | B2 | 9/2004 | Sugimura | |
| 7,350,902 | B2 | 4/2008 | Dietl et al. | |
| 7,988,255 | B2 | 8/2011 | Balcan et al. | |
| 2002/0126177 | A1 * | 9/2002 | Sugimura et al. | 347/29 |
| 2005/0174382 | A1 * | 8/2005 | Yoshikawa et al. | 347/30 |
| 2008/0158288 | A1 * | 7/2008 | Nagahara et al. | 347/30 |
| 2008/0158622 | A1 * | 7/2008 | Morinaga et al. | 358/498 |
| 2009/0174748 | A1 * | 7/2009 | Balcan et al. | 347/32 |

* cited by examiner

*Primary Examiner* — Roger W Pisha, II
(74) *Attorney, Agent, or Firm* — Peyton C. Watkins

(57) ABSTRACT

An inkjet printer includes a printhead; a carriage for moving the printhead back and forth in a carriage scan direction across the printing region; an output roller that is downstream of the printing region for moving recording medium away from the printing region, the output roller including a shaft; a pump that is coaxially disposed around the shaft of the output roller; and a restraining lever that disconnects the pump from power when the carriage is not in contact with the restraining lever.

19 Claims, 20 Drawing Sheets

FIG. 5 – Prior Art

CARRIAGE ACTIVATED PUMP FOR INKJET PRINTER

CROSS REFERENCE TO RELATED APPLICATION

Reference is made to commonly assigned, co-pending U.S. patent application Ser. No. 13/430,741, concurrently filed herewith, entitled "Pump Disposed Around Output Shaft of Inkjet Printer" by Juan Jimenez, the disclosure of which is herein incorporated by reference.

FIELD OF THE INVENTION

This invention relates generally to the field printhead maintenance in an inkjet printer, and more particularly to configurations of a pump for applying suction to the nozzles of an inkjet printhead.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device that changes the wall geometry of the ink pressurization chamber in order to generate a pressure wave that ejects a droplet. The droplets are typically directed toward paper or other print medium (sometimes generically referred to as recording medium or paper herein) in order to produce an image according to image data that is converted into electronic firing pulses for the drop ejectors as the print medium is moved relative to the printhead.

Motion of the print medium relative to the printhead can consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

In an inkjet printer, a part of the printhead maintenance station is a cap that is connected to a suction pump, such as a peristaltic or tube pump. The cap surrounds the printhead nozzle face during periods of nonprinting in order to inhibit evaporation of the volatile components of the ink. Periodically, the suction pump is activated to remove ink and unwanted air bubbles from the nozzles. The pump can be powered by a dedicated motor or by a motor, such as the media advance motor, that has other functions as well. A dedicated motor results in additional cost and takes up additional space in the printer. Prior art pumps driven from the media advance motor, such as those described in U.S. Pat. No. 7,988,255 and U.S. Pat. No. 6,793,316, are configured such that a gear train with a fairly large number of gears is needed for power transmission. Such a gear train can cause additional noise during operation, and requires additional drive power from the motor in order to turn the gears.

Consequently, a need exists for an inkjet printer pump and power transmission having improved drive efficiency, compact design, low cost and low operational noise when driven from a motor having additional function in the printer.

SUMMARY OF THE INVENTION

The present invention is directed to overcoming one or more of the problems set forth above. Briefly summarized, according to one aspect of the invention, the invention resides in an inkjet printer including a printing region, the inkjet printer comprising a printhead; a carriage for moving the printhead back and forth in a carriage scan direction across the printing region; an output roller that is downstream of the printing region for moving recording medium away from the printing region, the output roller including a shaft; a pump that is coaxially disposed around the shaft of the output roller; and a restraining lever that disconnects the pump from power when the carriage is not in contact with the restraining lever.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
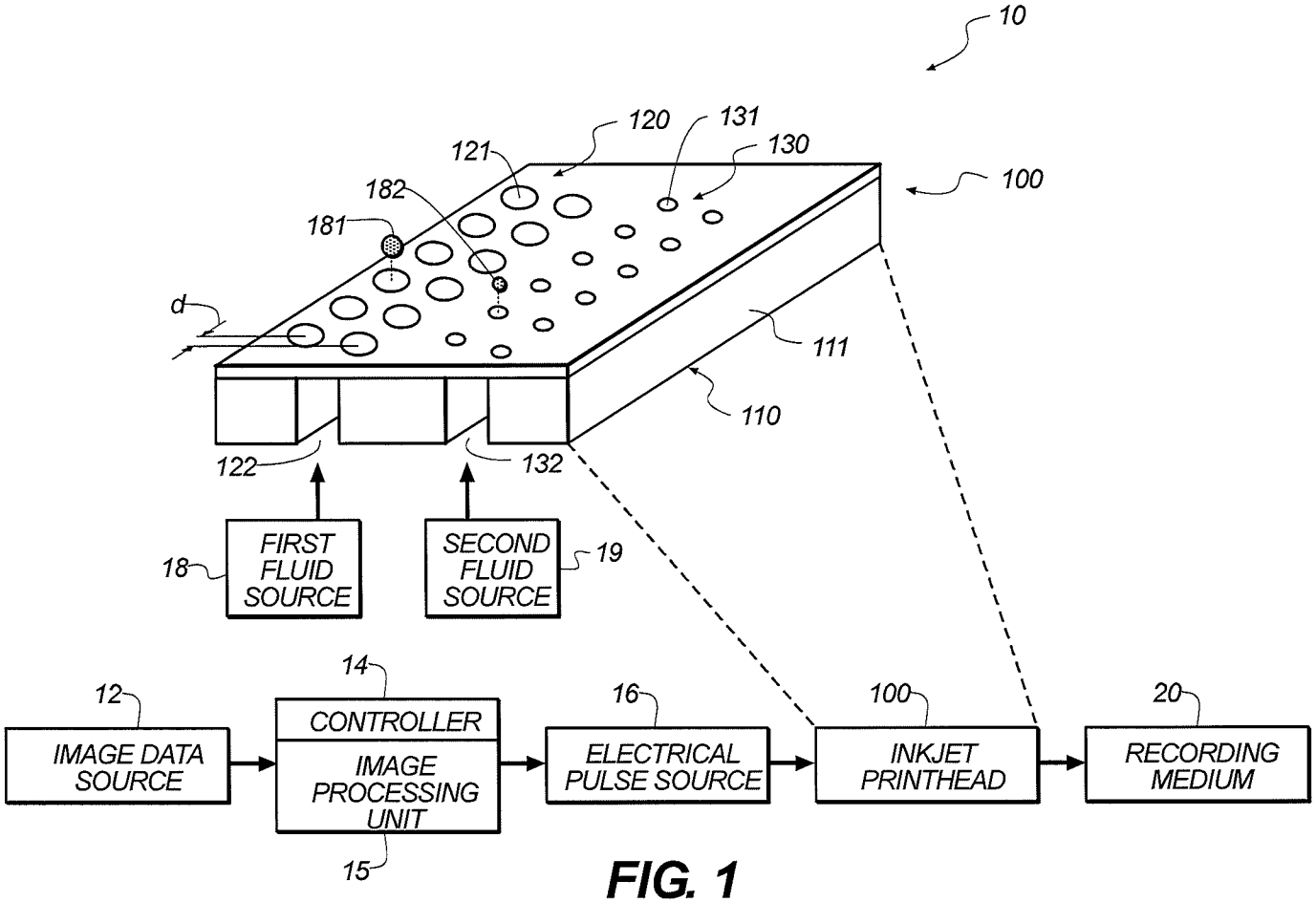
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays 120, 130. Nozzles 121 in the first nozzle array 120 have a larger opening area than nozzles 131 in the second nozzle array 130. In this example, each of the two nozzle arrays 120, 130 has two staggered rows of nozzles, each row having a nozzle density of 600 per inch. The effective nozzle density then in each array is 1200 per inch (i.e. $d=1/1200$ inch in FIG. 1). If pixels on a recording medium 20 were sequentially numbered along the paper advance direction, the nozzles 121, 131 from one row of a nozzle array 120, 130 would print the odd numbered pixels, while the nozzles 121, 131 from the other row of the nozzle array 120, 130 would print the even numbered pixels.

In fluid communication with each nozzle array 120, 130 is a corresponding ink delivery pathway 122. Ink delivery pathway 122 is in fluid communication with the first nozzle array 120, and an ink delivery pathway 132 is in fluid communication with the second nozzle array 130. Portions of the ink delivery pathways 122 and 132 are shown in FIG. 1 as openings through a printhead die substrate 111. One or more inkjet printhead die 110 will be included in the inkjet printhead 100, but for greater clarity only one inkjet printhead die 110 is shown in FIG. 1. The printhead die 110 are arranged on a mounting substrate member as discussed below relative to FIG. 2. In FIG. 1, a first fluid source 18 supplies ink to the first nozzle array 120 via the ink delivery pathway 122, and a second fluid source 19 supplies ink to the second nozzle array 130 via the ink delivery pathway 132. Although distinct fluid sources 18 and 19 are shown, in some applications it can be beneficial to have a single fluid source 18, 19 supplying ink to both the first nozzle array 120 and the second nozzle array 130 via the ink delivery pathways 122 and 132 respectively. Also, in some embodiments, fewer than two or more than two nozzle arrays 120, 130 can be included on the printhead die 110. In some embodiments, all nozzles 121, 131 on the inkjet printhead die 110 can be the same size, rather than having multiple sized nozzles 121, 131 on the inkjet printhead die 110.

The drop forming mechanisms associated with the nozzles 121, 131 are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from the electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120, 130 are also sized differently in order to optimize the drop ejection process for the different sized drops. During operation, droplets of ink are deposited on the recording medium 20.

Figure 2:
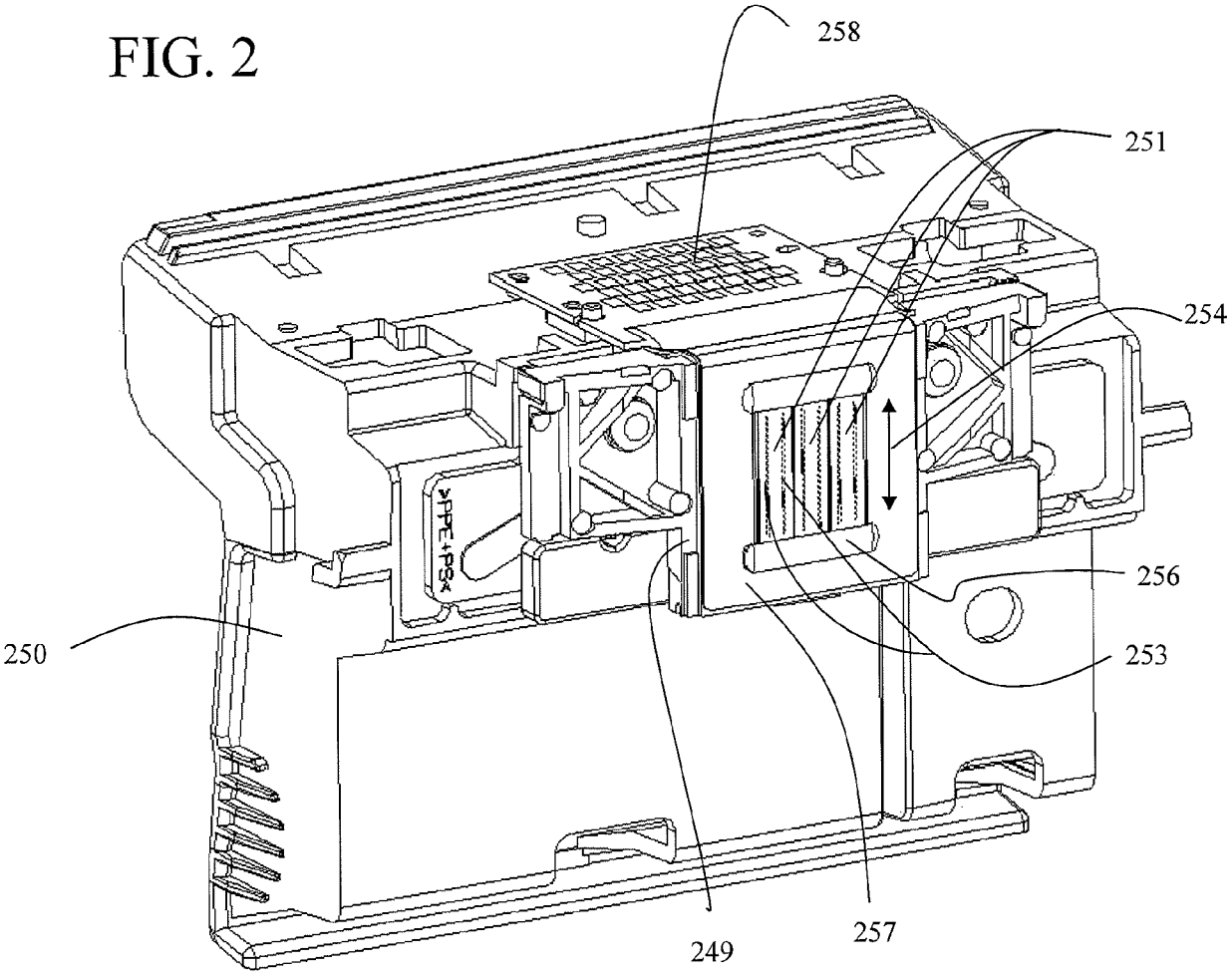
FIG. 2 is a perspective of a portion of a printhead.

FIG. 2 shows a perspective of a portion of a printhead 250, which is an example of an inkjet printhead 100. Printhead 250 includes three printhead die 251 (similar to printhead die 110 in FIG. 1) mounted on a mounting substrate 249, each printhead die 251 containing two nozzle arrays 253, so that the printhead 250 contains six nozzle arrays 253 altogether. For an inkjet printhead, the terms printhead die and ejector die will be used herein interchangeably. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along a nozzle array direction 254, and the length of each nozzle array 253 along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving the printhead 250 across the recording medium 20 (FIG. 1). Following the printing of a swath, the recording medium 20 is advanced along a media advance direction that is substantially parallel to the nozzle array direction 254.

The printhead die 251 are electrically interconnected to a flex circuit 257, for example by wire bonding or TAB bonding. The interconnections are covered by an encapsulating material 256 to protect them. Flex circuit 257 bends around the side of the printhead 250 and connects to a connector board 258. When the printhead 250 is mounted into a carriage 200 (see FIG. 3), the connector board 258 is electrically connected to a connector (not shown) on the carriage 200, so that electrical signals can be transmitted to the printhead die 251.

Figure 3:
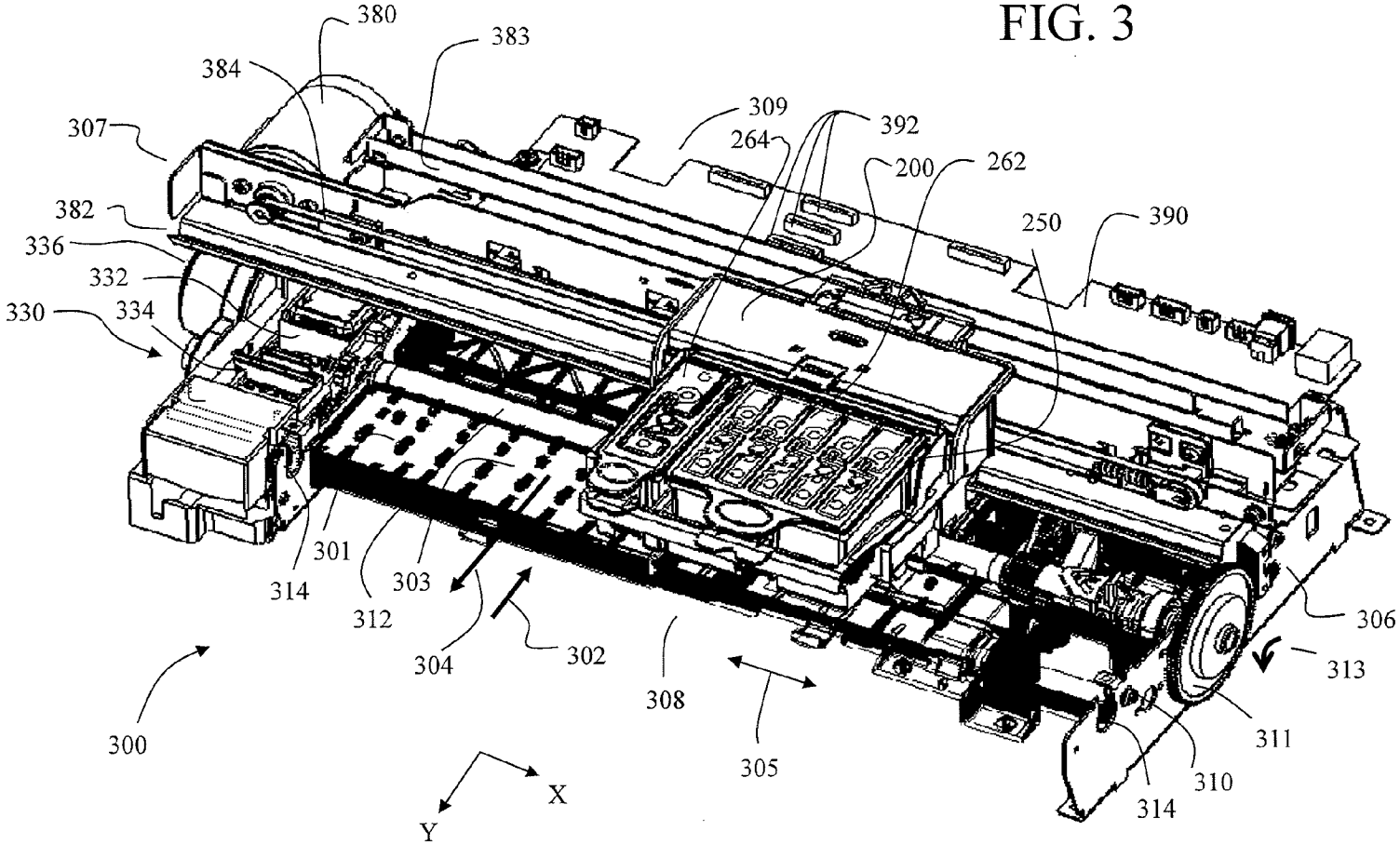
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. A printer chassis 300 has a print region 303 across which the carriage 200 is moved back and forth in a carriage scan direction 305 along the X axis, between a right side 306 and a left side 307 of the printer chassis 300, while drops are ejected from the printhead die 251 (not shown in FIG. 6) on the printhead 250 that is mounted on the carriage 200. A platen 301 (which optionally includes ribs) supports the recording medium 20 (FIG. 1) in the print region 303. A carriage motor 380 moves a belt 384 to move the carriage 200 along a carriage guide 382. An encoder sensor (not shown) is mounted on the carriage 200 and indicates carriage location relative to an encoder fence 383.

The printhead 250 is mounted in the carriage 200, and a multi-chamber ink supply 262 and a single-chamber ink supply 264 are mounted in the printhead 250. The mounting orientation of the printhead 250 is rotated relative to the view in FIG. 2, so that the printhead die 251 are located at the bottom side of the printhead 250, the droplets of ink being ejected downward toward the platen 301 in the print region 303 in the view of FIG. 3. A multi-chamber ink supply 262, in this example, contains five ink sources: cyan, magenta, yellow, photo black, and colorless protective fluid; while a single-chamber ink supply 264 contains the ink source for text black. Paper or other recording medium 20 (sometimes generically referred to as paper or print medium or media herein) is loaded along a paper load entry direction 302 toward the front of a printer chassis 308.

Figure 4:
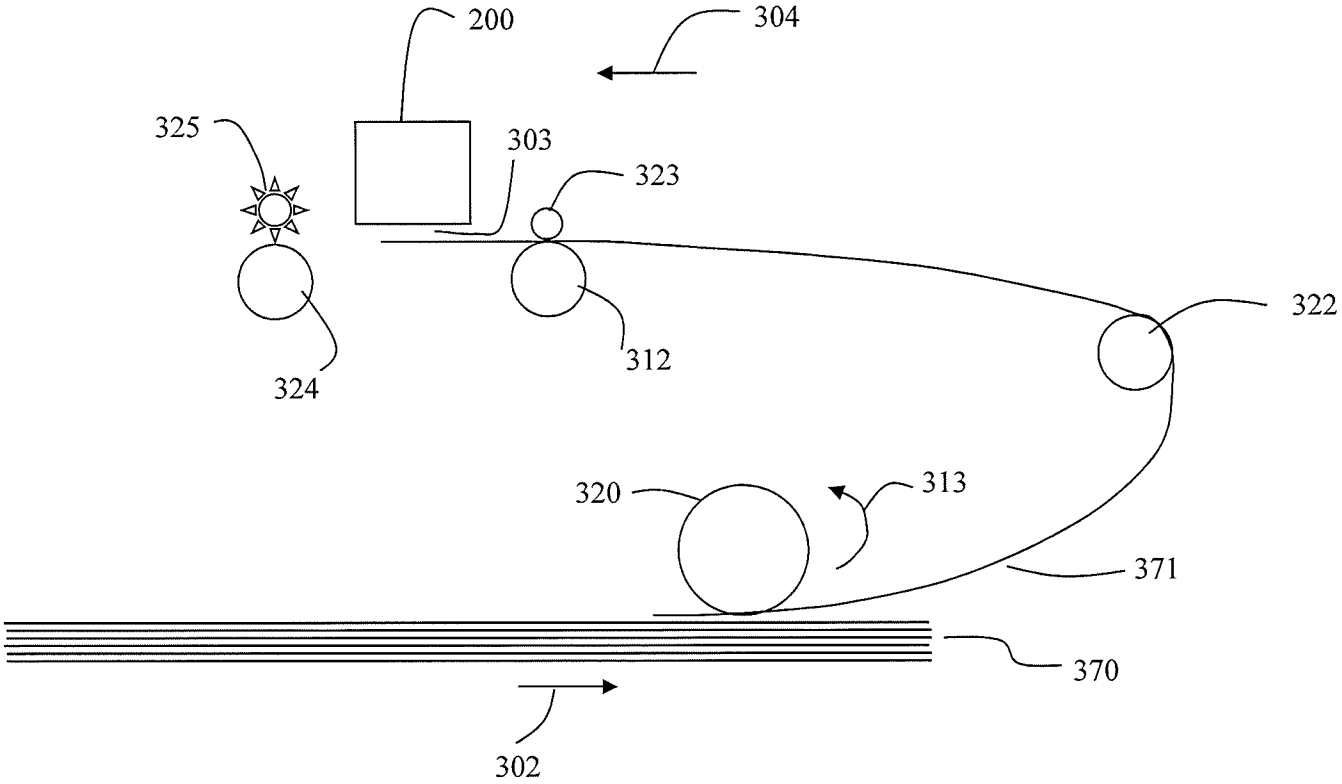
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves a top piece or sheet 371 of a stack 370 of paper or other recording medium 20 in the direction of arrow, the paper load entry direction 302. A turn roller 322 acts to move the paper around a C-shaped path (in cooperation with a curved rear wall surface) so that the paper continues to advance along a media advance direction 304 from a rear 309 of the printer chassis (with reference also to FIG. 3). The paper is then moved by a feed roller 312 and idler roller(s) 323 to advance along the Y axis across the print region 303, and from there to an output roller 324 and a star wheel(s) 325 so that printed paper exits along the media advance direction 304. The feed roller 312 includes a feed roller shaft along its axis, and a feed roller gear 311 (see FIG. 3) is mounted on the feed roller shaft. The feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

Referring to FIG. 3, the motor that powers the paper advance rollers is not shown, but a hole 310 at the right side 306 of the printer chassis 300 is where the motor gear (not shown) protrudes through in order to engage the feed roller gear 311, as well as the gear for the output roller (not shown). Although the output roller 324 is not shown in FIG. 3, shaft mounts 314 for the shaft of the output roller 324 are shown. Referring to FIG. 4, for normal paper pick-up and feeding, it is desired that all rollers rotate in a forward rotation direction 313. The feed roller 312 is upstream of the printing region 303 and advances the recording medium 20 toward the printing region 303 prior to printing. The output roller 324 is downstream of the printing region 303 and is for moving recording medium 20 away from the printing region 303.

Referring back to FIG. 3, toward the rear side 309 of the printer chassis 300, in this example, is located an electronics board 390, which includes cable connectors 392 for communicating via cables (not shown) to the printhead carriage 200 and from there to the printhead 250. Also on the electronics board 390 are typically mounted motor controllers for the carriage motor 380 and for the paper advance motor, a processor and/or other control electronics (shown schematically as the controller 14 and the image processing unit 15 in FIG. 1) for controlling the printing process, and an optional connector for a cable to a host computer.

Figure 5:
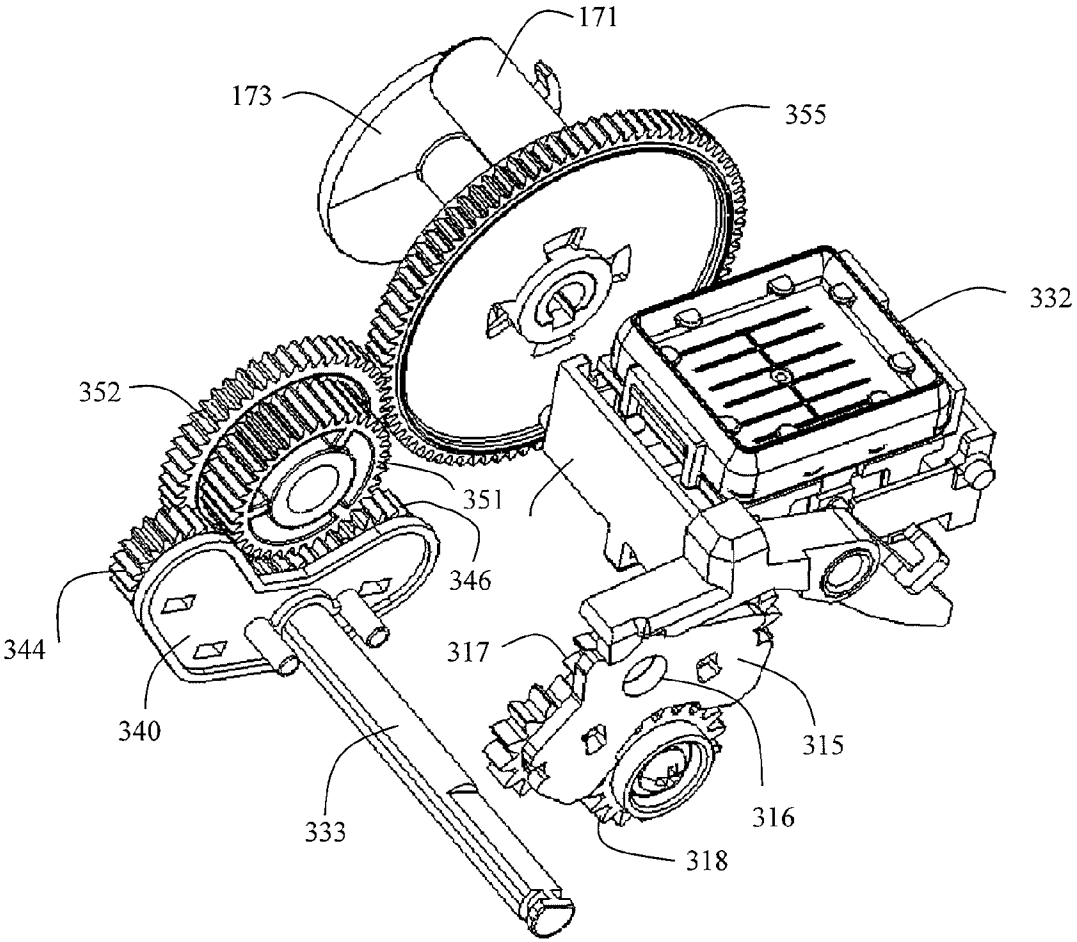
FIG. 5 is a prior art gear train configuration for providing power to a peristaltic pump.

Toward the left side 307 of the printer chassis 300 is a maintenance station 330 including a cap 332, a wiper 334 and a pump 336. The operation of this maintenance station is described in more detail in U.S. Pat. No. 7,988,255, which is incorporated by reference herein in its entirety. The pump 336 is driven by a set of gears and shafts as can be understood with reference to prior art FIG. 5. The shaft of feed roller 312 (FIG. 3) extends through a hole 316 in a pivot arm 315 to drive a feed roller pinion 317. Two other gears (unlabeled) on the pivot arm 315 are engaged with the feed roller pinion 317 and selectively engage a pivot arm gear 318 depending on whether the feed roller 312 is rotating in the forward direction 313 (FIG. 3) or in a reverse direction. The pivot arm gear 318 transmits power to a drive shaft 333 through two gears that are not shown. The drive shaft 333 transmits power to a gear train including a first gear 344, a second gear 346, compound gears 351 and 352, and other gears (not shown) on the other side of a toggle arm 340. An external housing of pump 336 (FIG. 3) is hidden in FIG. 5 so that some of the inner workings of the peristaltic pump can be seen. In particular, the compound gear 352 drives a pump cam gear 355 to rotate a pump roller cam 173. The pump roller cam 173 pushes a pump roller 171 into rolling engagement with flexible tubing (not shown) to compress the flexible tubing against an inner surface of the housing (not shown) thereby producing a suction. One end of the flexible tubing (not shown) goes to the cap 332 (see FIG. 3) to provide a suction force that can be used either to suck on the nozzles 121, 131 of the printhead 250 when the cap 332 (see FIG. 3) is sealed around the nozzle face of the printhead 250, or to discharge excess ink from the cap 332 through the other end of the flexible tubing (not shown). The numerous gears required in prior art FIG. 5 to drive the pump can cause noise, take up space, and reduce the driving efficiency due to friction in the gears.

Embodiments of the present invention drive the pump 336 directly from the shaft of the output roller 324 in order to eliminate the numerous gears required in the prior art to drive the pump from the feed roller 312. In this way, embodiments of the invention provide improved drive efficiency, compact design, low cost and low operational noise. The pump 336 is selectively activated when needed but is independent of the rotation of the output roller shaft when the output roller shaft is used for advancing recording medium. A variety of configurations will be described to illustrate different ways that the output roller 324 can be driven, different ways the power can be transmitted to the pump 336, different ways the power transmission can be activated, and different ways the pump 336 is aligned to the output roller shaft, for example. The configurations, as well as various combinations of their elements, illustrate some of the ways that are contemplated for implementing the invention in an inkjet printer.

Figure 6:
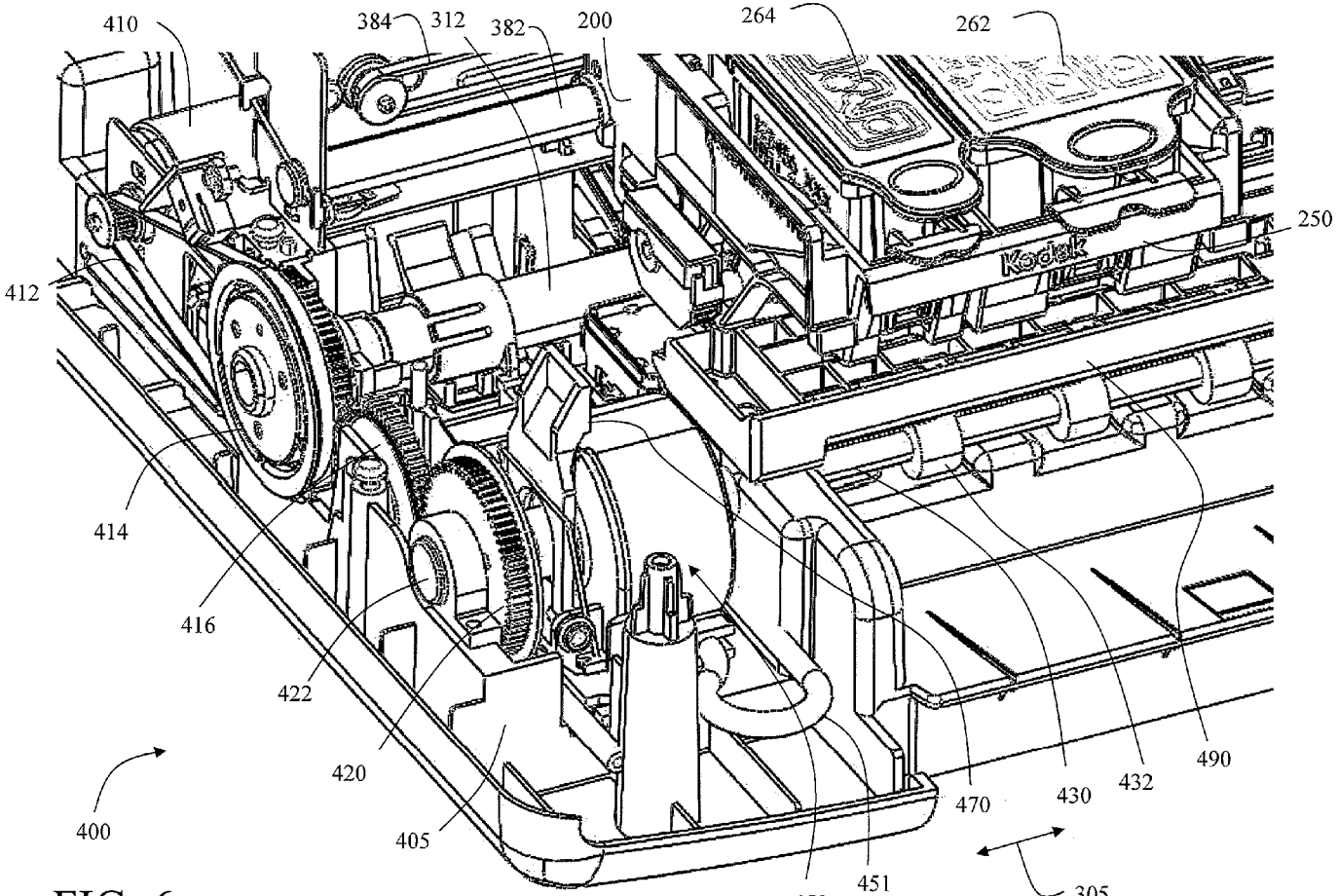
FIG. 6 is a perspective of a portion of a carriage printer including a pump coaxially disposed around the output roller shaft according to an embodiment of the invention.

FIG. 6 is a close-up perspective of a portion of a printer chassis 400 according to an embodiment of the invention. The printer chassis 400 includes a frame 405 on which various components are mounted. Many of the components are similar to those in the printer chassis 300, including the carriage 200, the printhead 250, the multi-chamber ink supply 262, the single chamber ink supply 264, the feed roller 312, the carriage guide 382 and the belt 384 for carriage drive. As in FIG. 3, the carriage 200 moves the printhead 250 back and forth across the printing region 303 (FIG. 3) along the carriage scan direction 305. In the example shown in FIG. 6, a media advance motor 410 transfers power to the feed roller 312 by a pulley and gear 414 through a drive belt 412. The gear of pulley and gear 414 transfers power to an output roller gear 420 through an idler gear 416. The output roller gear 420 is attached to an output roller shaft 430 so that when the output roller gear 420 rotates, it causes the output roller shaft 430 to rotate. The output roller gear 420 functions as a drive member for transmitting rotational power from the media advance motor 410 to the output roller shaft 430. A bushing 422 around the output roller shaft 430 provides a low friction mount. Output rollers 432 are mounted on the output roller shaft 430 and serve the same function as the output roller 324 (FIG. 4). The printing region 303 (FIGS. 3 and 4) is not shown in FIG. 6, but is below the printhead 250. The output roller 432 is downstream of the printing region 303 and is configured to move the recording medium 20 away from the printing region 303. A star wheel assembly 490 is positioned over the output roller shaft 430 and biases the star wheels 325 (FIG. 4) against each of the output rollers 430. The star wheel assembly 490 extends a length that is approximately equal to a printing length of the platen 301 (FIG. 3), where the printing length of the platen 301 determines the widest recording medium 20 that can be printed. In conventional inkjet printers, the space beyond the star wheel assembly 490 is not efficiently used. By locating pump 450 of the present invention in the region beyond the star wheel assembly 490 (displaced from the star wheel assembly 490 along a direction parallel to the carriage scan direction 305), the space is more efficiently used. Thus, the design of the printer chassis 400 (FIG. 6) is more compatible with compact design or inclusion of additional features than is the design of the printer chassis 300 (FIG. 3) because of the relocation of pump 450. In addition, as seen in FIG. 6, the pump 450 is coaxially disposed around the output roller shaft 430. A portion of a flexible tubing 451 is also shown in FIG. 6. A further important feature shown in FIG. 6 is a lever 470, which permits rotational power to be engaged with the pump 450 when the carriage 200 moves the lever 470 to a predetermined position, as described in further detail below.

Figure 7:
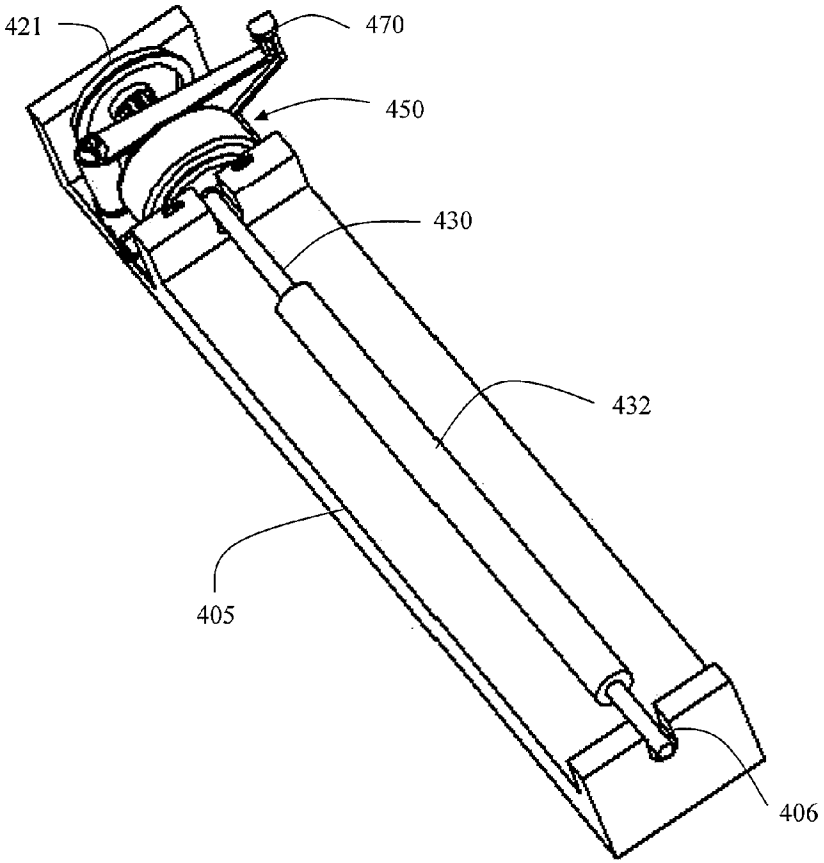
FIG. 7 is a perspective of the output roller shaft and the pump according to an embodiment of the invention.

FIGS. 7-13 show an embodiment of the pump 450 disposed coaxially around the output shaft 430. Other parts of the printer (including the star wheel assembly 490) are hidden for improved visibility of the output roller 430 and the pump 450. In the example of FIG. 7, the frame 405 includes at least one shaft mount 406 for the output roller shaft 430. A single elongated output roller 432 is shown in this example, rather than the plurality of smaller output rollers 432 shown in the example of FIG. 6. The pump 450 is coaxially disposed around the output roller shaft 430. A different type of lever 470 than was shown in FIG. 6 is shown in FIG. 7, and both types will be described in further detail below.

Figure 8:
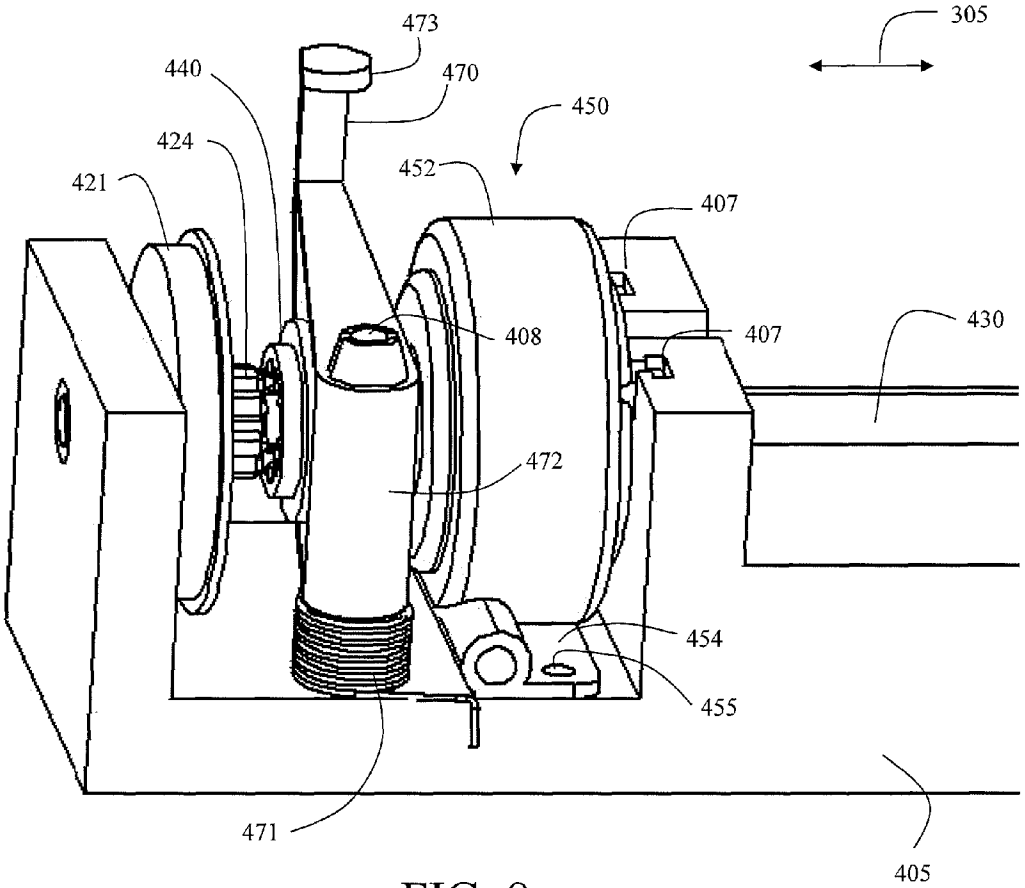
FIGS. 8-13 are close-up perspectives of portions of the pump of FIG. 7 and its driving mechanisms.

FIG. 8 shows a close-up side perspective of the pump 450, drive member 421 and the lever 470. The pump 450 includes a housing 452 that has a bracket 454 including a hole 455 for a bolt (not shown) or other similar attachment device for affixing the housing 452 to the frame 405. The frame 405 includes a pair of slots for aligning the pump housing 452 as described below. A drive member 421 is a pulley for the belt driving the output roller shaft 430 in this example, but could alternatively be a gear as in FIG. 6. Extending from the drive member 421 is a drive coupling member 424 that is coaxially disposed around the output roller shaft 430 such that the rotation of the output roller shaft 430 is not independent of rotation of the drive coupling member 424. A slidable coupler 440 is configured to selectively link the pump 450 to rotational power provided by the drive coupling member 424. The slidable coupler 440 is coaxially disposed around the output roller shaft 430 and can be moved toward the drive member 421 to engage the drive coupling member 424 or moved away from the drive member 421 to disengage the drive coupling member 424. FIG. 8 shows the slidable coupler 440 as disengaged from drive coupling member 424. The lever 470 includes a first end 472 that is pivotably mounted on a pivot pin 408 that extends vertically from the frame 405. A second end 473 of the lever 470 (opposite first end 472) is disposed in a carriage motion path as the carriage 200 (FIG. 6) moves along the carriage scan direction 305. The lever 470 also includes an opening 475 (FIG. 13) through which the slidable coupler 440 extends. The opening 475 is located between the first end 472 and the second end 473 of the lever 470. In normal printing operation when the carriage 200 (FIG. 6) is not in contact with the second end 473 of the lever 470 (as in FIG. 8), a torsional spring 471, which is coaxial with the pivot pin 408, biases the slidable coupler 440 out of engagement with the drive coupling member 424. When the carriage 200 moves into contact with the second end 473 of the lever 470 and pushes the second end 473 to a predetermined position, the slidable coupler 440 is pushed by the lever 470 against the force of the torsional spring 471 toward the drive member 421 so that the slidable coupler 440 engages with the drive coupling member 424. For embodiments, such as the one shown in FIGS. 7-14, where movement of the lever 470 by the carriage 200 causes the slidable coupler 440 to engage with the drive coupling member 424, the lever 470 will be called an engagement lever herein.

Figure 9:
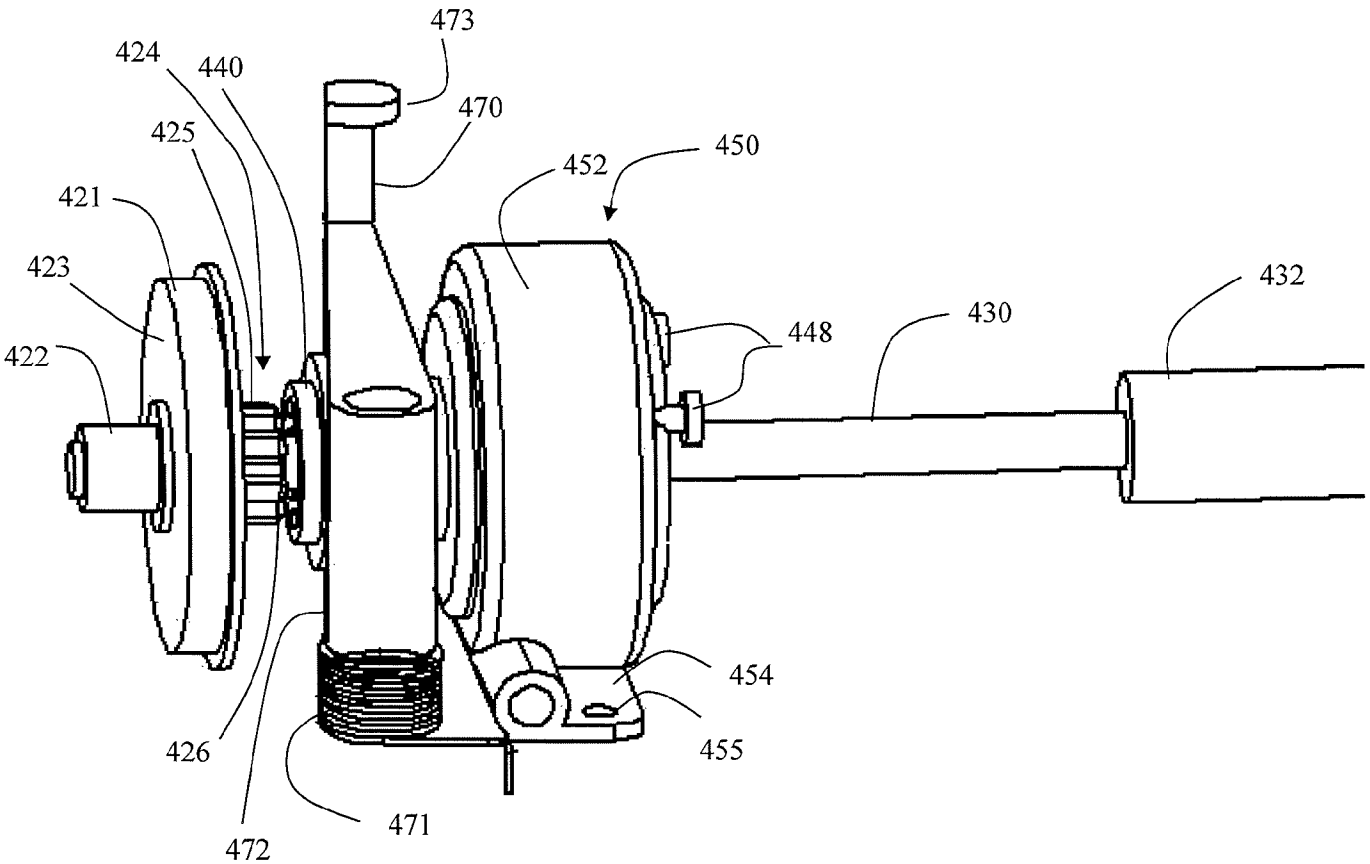

FIG. 9 is similar to the view shown in FIG. 8, but with the frame 405 removed. Visible in FIG. 9 are two pins 448 extending from the housing 452 of pump 450, where the pins 448 are configured to fit into slots 407 of the frame 405 (FIG. 8). The pins 448 include heads that have a larger diameter than the shaft of the pin 448. The slots 407 (see FIG. 8) have a widened internal portion to accommodate the head of the pin 448. The star wheel assembly 490 (FIG. 6) presses down on the heads of the pins 448 in order keep them pushed down in the slots 407 for proper pump positioning. The pins 448 and slots 407 are used to align the pump 450 to the frame 405. Since the frame 405 holds the output roller shaft 430 (FIG. 6), this effectively aligns the pump 450 to the output roller shaft 430. Proper alignment is important. The pump 450 is coaxially disposed around the output roller shaft 430, but the housing 452 of pump 450 should not touch the output roller shaft 430, so that no frictional drag is present between pump housing 452 and the output roller shaft 430. The bushing 422 is also shown in FIG. 9 as extending from an outer face 423 of the drive member 421. In some embodiments it is cost advantageous to integrally form the bushing 422 with the drive member 421 out of the same material, for example by injection molding, in order to reduce parts count and facilitate assembly.

Figure 10:
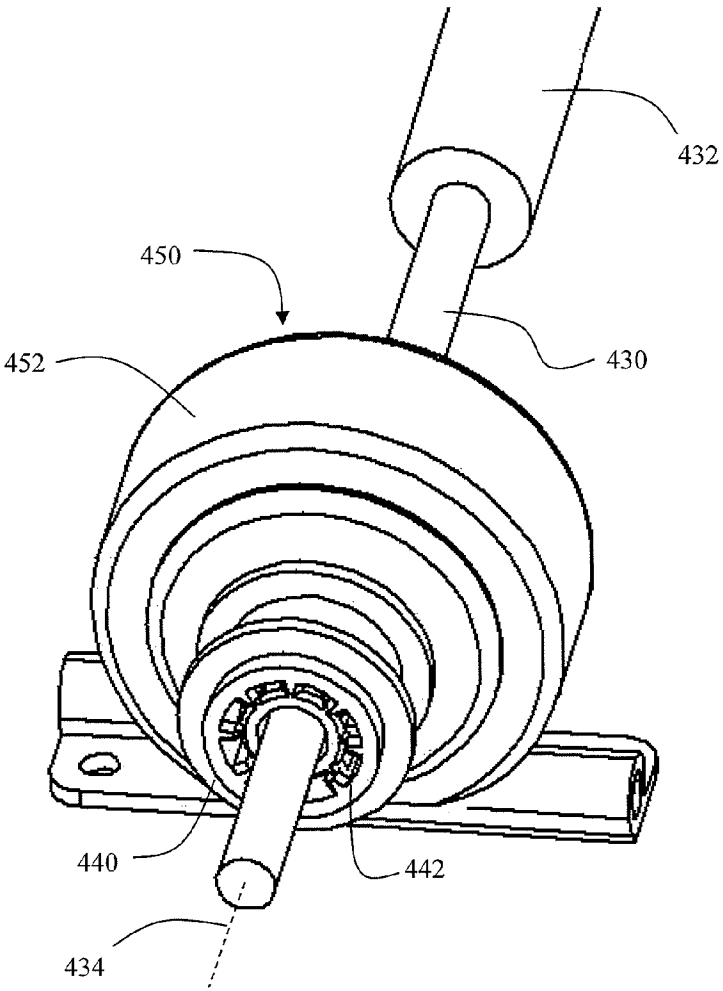
Figure 11:
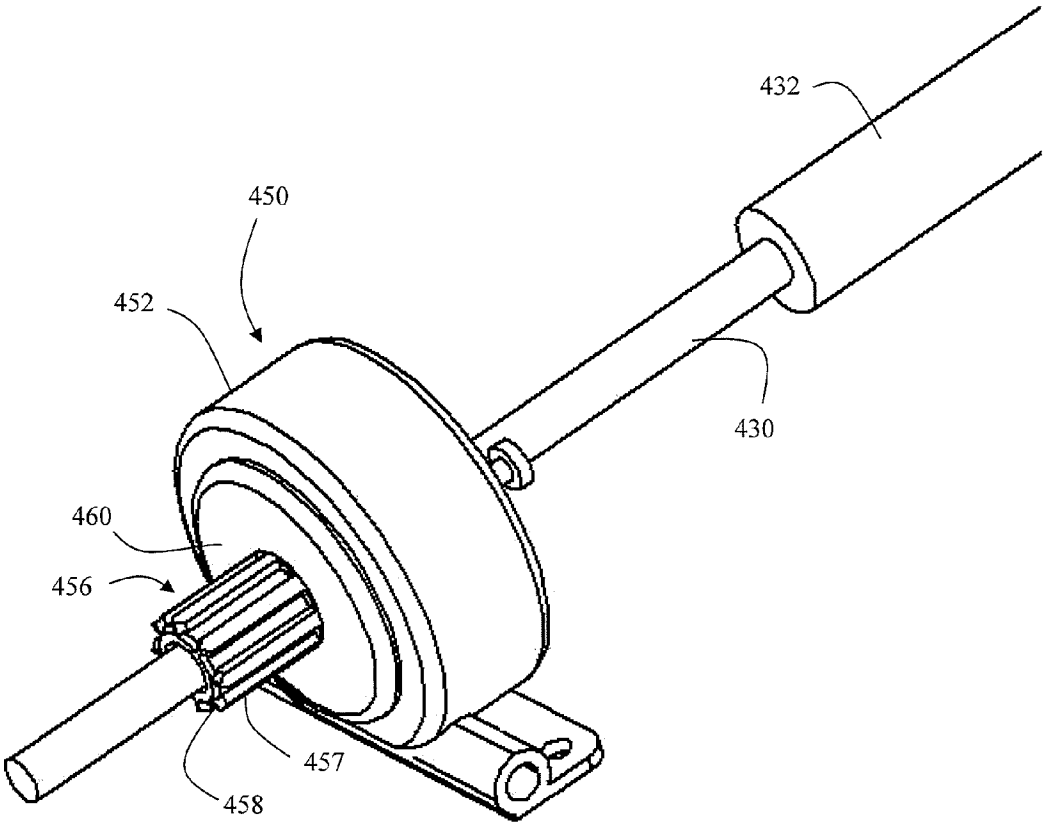

FIG. 10 is an end perspective view of the pump 450 disposed coaxially around the output roller shaft 430. An axis 434 of output roller shaft is shown. Also visible from this perspective are grooves 442 disposed axially within the slidable coupler 440 for the purpose of coupling with splines 457 on outer surfaces of a pump coupling member 456 (FIG. 11). FIG. 11 has the slidable coupler 440 hidden so that the pump coupling member 456 can be seen. In some embodiments, the slidable coupler 440 is configured to always be engaged with the pump coupling member 456. Optionally ends 458 of splines 457 can be tapered so that they are readily inserted into grooves 442 in order to facilitate engagement. In some embodiments, the grooves 442 are disposed at both ends of the slidable coupler 440 (see FIGS. 9 and 10). For example, the grooves 442 can extend from one end of the slidable coupler 440 to the other end. With reference to FIG. 9, ends 426 of splines 425 on the drive coupling member 424 can be tapered so that they are readily inserted into the grooves 442 (see FIG. 10) of the slidable coupler 440 (see FIGS. 9 and 10) in order to facilitate engagement. The pump coupling member 456 is affixed to a pump cam 460, so that causing the pump coupling member 456 to rotate also causes the pump cam 460 to rotate. Further details regarding the function of the pump cam 460 in a peristaltic pump are provided below.

Figure 12:
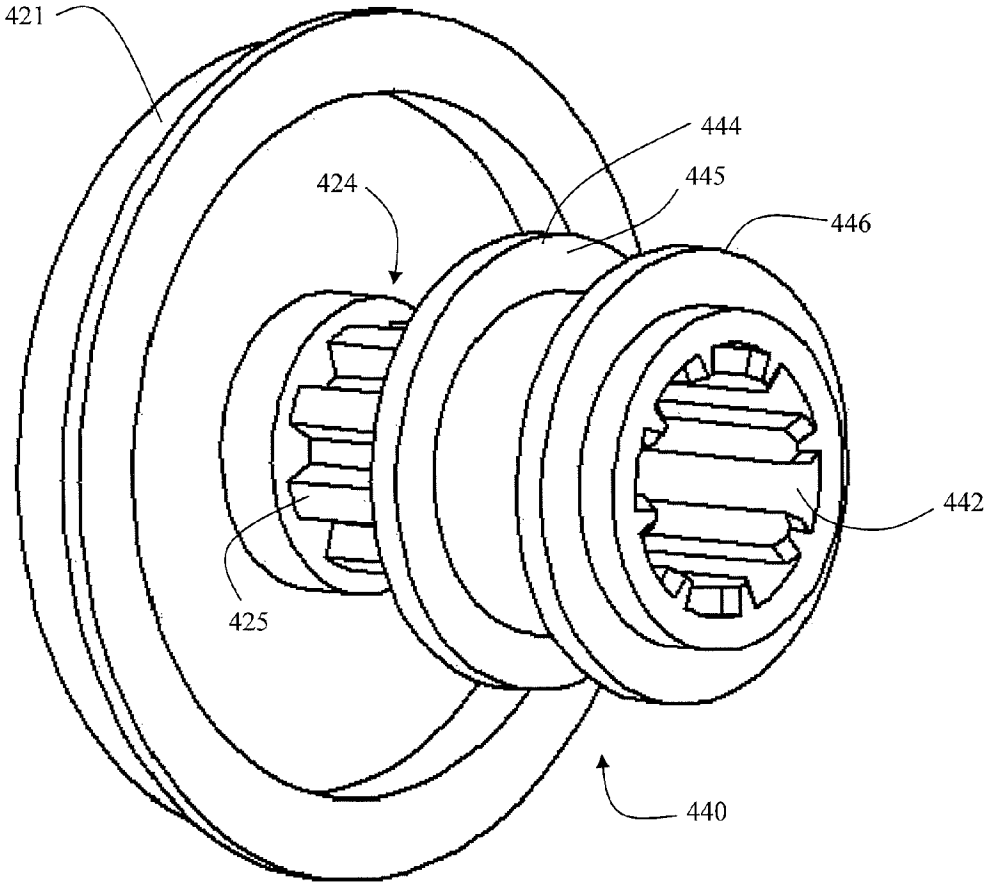

FIG. 12 shows a close-up perspective of the drive member 421 together with the slidable coupler 440. The slidable coupler 440 has a first flange 444 that faces the drive member 421 and a second flange 446 that is opposite the first flange 444. When the slidable coupler 440 is pushed toward the drive member 421, for example by pushing on a face 445 of the first flange 444, the splines 425 on the drive coupling member 424 become engaged with the grooves 442 of the slidable coupler 440.

Figure 13:
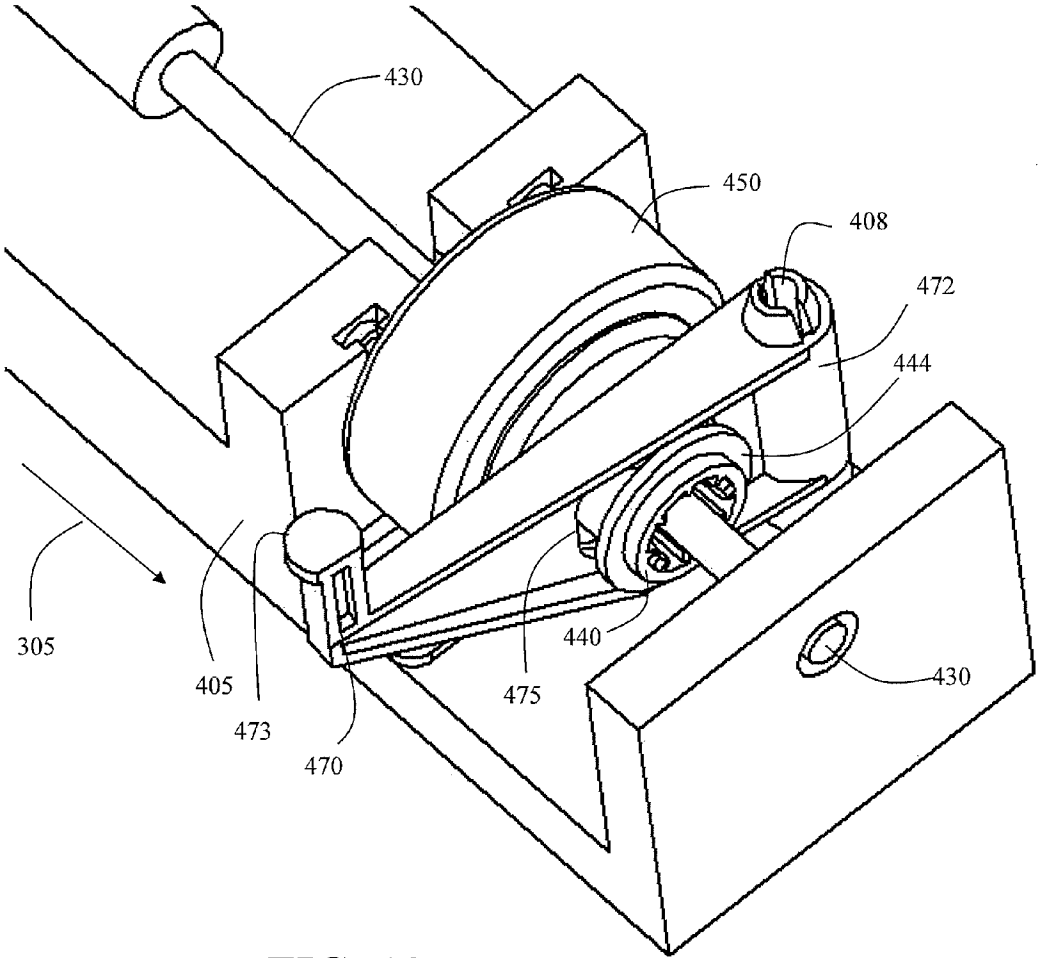

FIG. 13 shows an end perspective of the pump 450, frame 405, output roller shaft 430, slidable coupler 440 and lever 470. As can be seen, the slidable coupler 440 is inserted into the opening 475 of the lever 470 so that (with reference to FIG. 12) the lever 470 can move between the first flange 444 and the second flange 446. When the carriage 200 (FIG. 6) approaches the second end 473 of the lever 470 along the carriage scan direction 305 and moves the second end 473 in a direction away from pump 450, the lever 470 pivots at its first end 472 around the pivot pin 408. As the lever 470 continues its pivoting motion, it pushes face 445 (FIG. 12) of the first flange 444 so that the slidable coupler 440 is pushed axially until it engages with the drive coupling member 424 (FIG. 9). Rotation of the drive member 421 and the drive coupling member 424 then causes the slidable coupler 440 to rotate. Since the slidable coupler 440 continues to be engaged with the pump coupling member 456 (FIG. 11), the rotational power is transmitted to the pump 450. When the carriage 200 subsequently moves away along the carriage scan direction 305 in the opposite direction and is no longer in contact with the second end 473 of the lever 470, the torsional spring 471 (FIG. 9) biases the lever 470 to push the second flange 446 (FIG. 12) away from the drive member 421, thereby disengaging the slidable coupler 440 from the drive coupling member 424.

Figure 14:
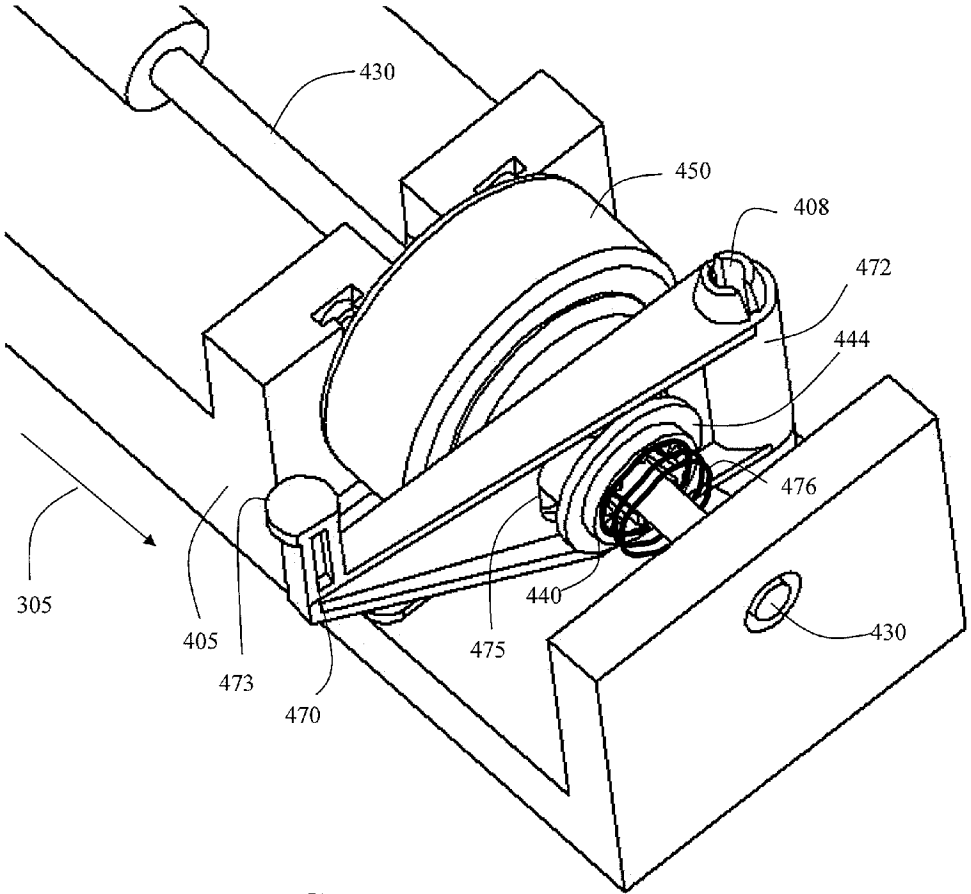
FIG. 14 is similar to FIG. 13, but with a different type of spring for keeping the pump normally disengaged.

In some embodiments, as shown in FIG. 14, a compression spring 476 is used instead of the torsional spring 471 (FIG. 9) in order to bias the slidable coupler 440 out of engagement with the drive coupling member 424 (FIG. 9) when the carriage 200 is not in contact with the second end 473 of the lever 470. The compression spring 476 is coaxially mounted on the output roller shaft 430 between the drive member 421 (FIG. 9) and the first flange 444 of the slidable coupler 440 that faces the drive member 421.

Figure 15:
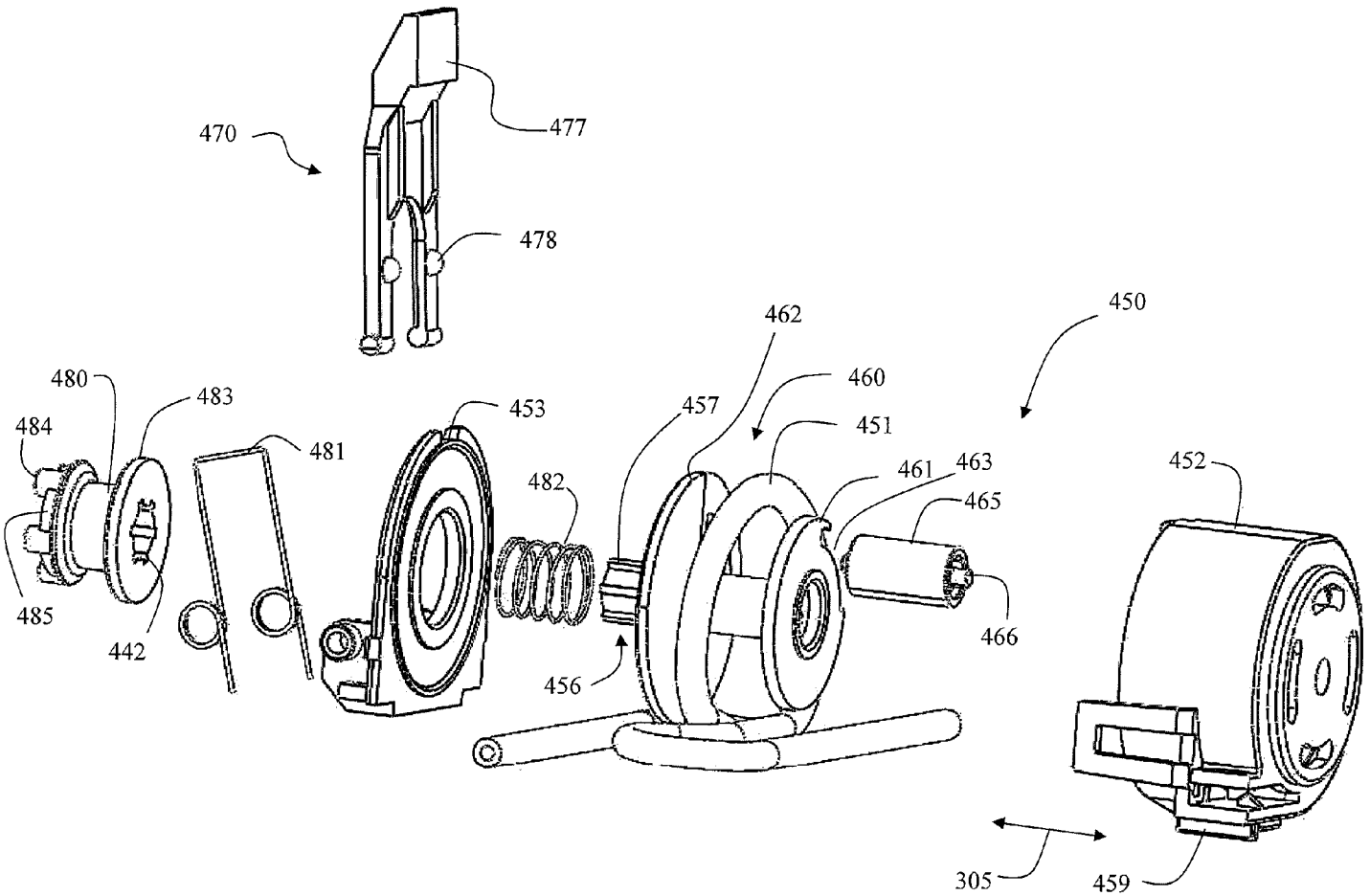
FIG. 15 is an exploded view of a peristaltic pump and some driving engagement components according to an embodiment of the invention.
Figure 16:
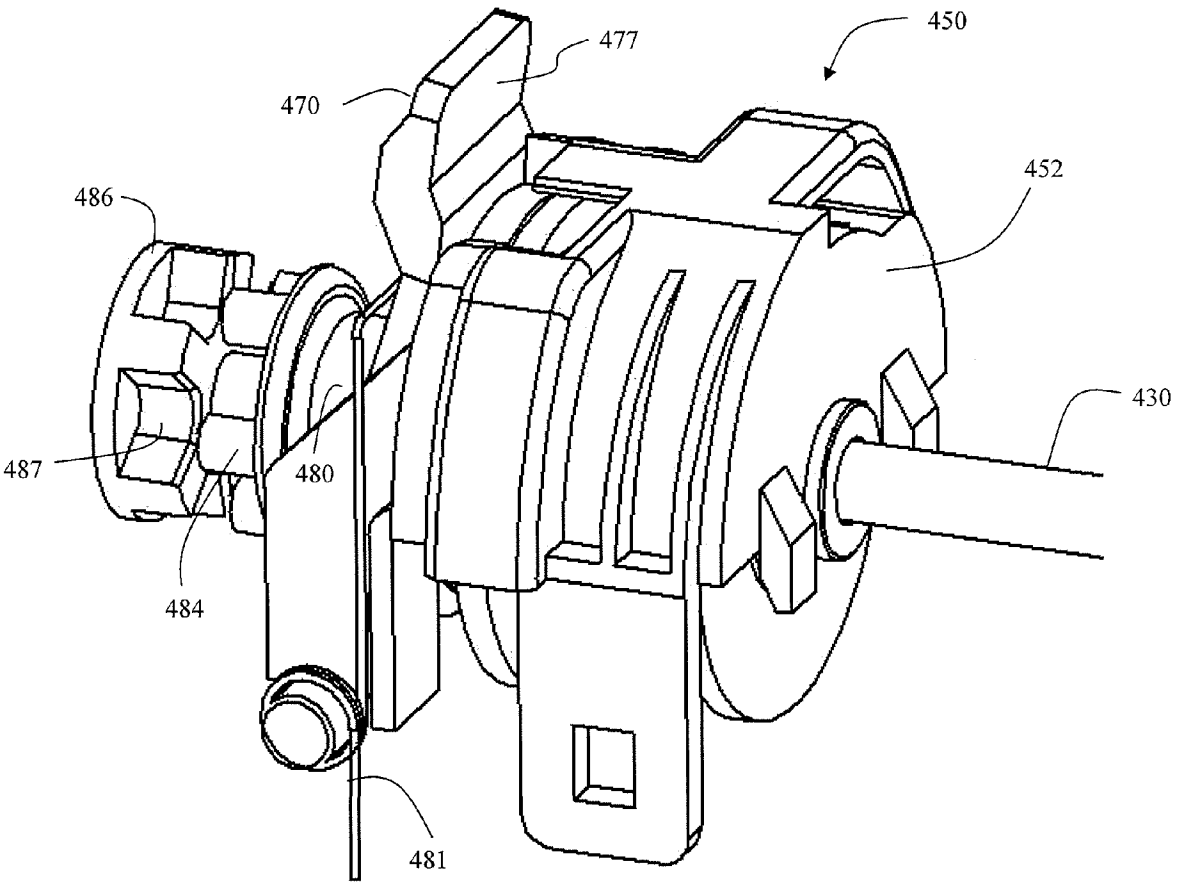
FIGS. 16-19 are close-up perspectives of portions of the pump of FIG. 15 and its driving mechanisms.

A type of pump that is commonly used in inkjet printers is a peristaltic pump, also called a tube pump. FIG. 15 shows an exploded view of a peristaltic pump 450 together with some other components that will be described below relative to an embodiment further illustrated in FIGS. 16-19. However, the peristaltic pump 450 itself can also be used in the embodiment described above with reference to FIGS. 7-14. Peristaltic pump 450 includes the pump housing 452 and a pump cover 453. Inside the pump housing 452 is the pump cam 460 having a first cam member 461 and a second cam member 462. A pump roller 465 has a pin 466 at each end to engage with curved slots 463 and 464 (FIGS. 17 and 18) in the first cam member 461 and the second cam member 462 respectively. The pump coupling member 456 extends from the pump cam 460. When the pump coupling member 456 rotates it causes the pump cam 460 to rotate, which drives the pump roller 465 to roll along the curved slots 463 and 464. This produces a moving compression point of the flexible tubing 451 against an interior wall of pump housing 452, thereby causing suction in the flexible tubing 451. The pump coupling member 456 is coaxially disposed around the output roller shaft 430. The pump coupling member 456 is not affixed to the output roller shaft 430, so that the output roller shaft 430 can rotate independently of the pump coupling member 456. In this way, when the output roller shaft 430 is rotated for moving recording medium 20 away from the printing zone 303, it does not cause a pumping action in the pump 450. In addition, although the pump housing 452 is coaxially disposed around the output roller shaft 430, the pump housing 452 should not touch the output roller shaft 430 so that it does not cause frictional drag. The pump housing 452 can have a feature such as a rib 459 extending parallel to the carriage scan direction 305 that provides alignment of the pump housing 452 with the frame 405 (FIG. 6), and thereby with the output roller shaft 430.

In the embodiment described above with reference to FIGS. 7-14, the lever 470 is an engagement lever such that movement of the lever 470 by the carriage 200 causes the slidable coupler 440 to engage with the drive coupling member 424. In an embodiment described below with reference to FIGS. 15-19, the lever 470 is a restraining lever that disconnects the pump 450 from power when the carriage 200 is not in contact with the lever 470. In particular, in the embodiment of FIGS. 15-19, the pivotable lever 470 is biased by a force applied by a bent torsion spring 481 to push against an inner face of a flange 483 of a slidable coupler 480 to move the slidable coupler 480 away from and out of engagement with a shaft coupling member 486 (FIG. 16), thereby restraining the slidable coupler 480 from engaging the shaft coupling member 486. Raised protuberances 478 on the lever 470 contact the inner face of the flange 483 of the slidable coupler 480. A compression spring 482 (FIGS. 15 and 19) applies a force to push the slidable coupler 480 toward the shaft coupling member 486. However, the bent torsion spring 481 is configured to be stronger than the compression spring 482, such that if the carriage 200 (FIG. 6) is not in contact with a face 477 of the lever 470, the bent torsion spring 481 causes the lever 470 to push the slidable coupler 480 out of engagement with the shaft coupling member 486. When the carriage 200 contacts the face 477 of the lever 470 to pivot the lever 470 against the force applied by the bent torsion spring 481, the compression spring 482 pushes the slidable coupler 480 toward the shaft coupling member 486 and into engagement.

Figure 20:
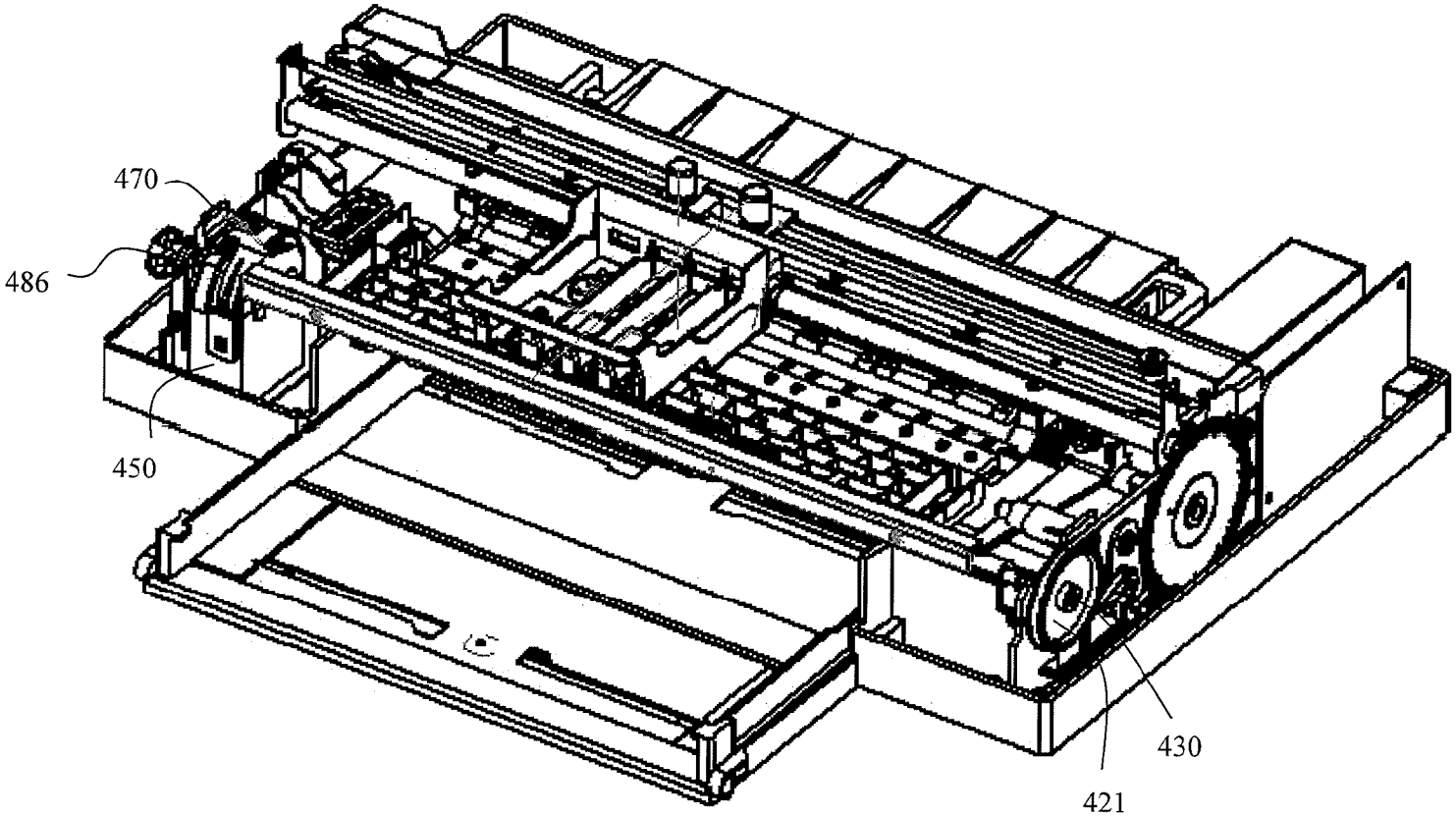
FIG. 20 is a perspective of a printer chassis having a pump disposed coaxially about the output roller shaft according to an embodiment of the invention.

The shaft coupling member 486 is affixed to the output roller shaft 430 so that it rotates whenever the output roller shaft 430 rotates. The drive member 421 transmits rotational power from the media advance motor to the output roller shaft 430. In some embodiments (as in FIG. 6) the shaft coupling member 486 (not shown in FIG. 6) is located near the drive member such as output roller gear 420 of FIG. 6. In other embodiments (as in FIG. 20), the shaft coupling member 486 is located near an opposite end of output roller shaft 430 from the drive member 421, so that output roller shaft transmits rotational power from drive member 421 to shaft coupling member 486.

The slidable coupler 480 is configured to selectively link the pump coupling member 456 to the shaft coupling member 486. With reference to FIG. 15, the pump coupling member 456 can have splines 457 that engage with grooves 442 in a shaft coupling member 486. The slidable coupler 480 is coaxially disposed around the output roller shaft 430 and can be moved toward the shaft coupling member 486 for engagement or moved away from the shaft coupling member 486 for disengagement. The slidable coupler 480 can optionally engage the shaft coupling member 486 by grooves and splines, but a different engagement configuration is shown in the example of FIGS. 16-19. In particular, projections 484 extend from a face 485 of the slidable coupler 480 that is near the shaft coupling member 486. The shaft coupling member 486 has recesses 487 in its face that are configured to engage projections 484.

Figure 17:
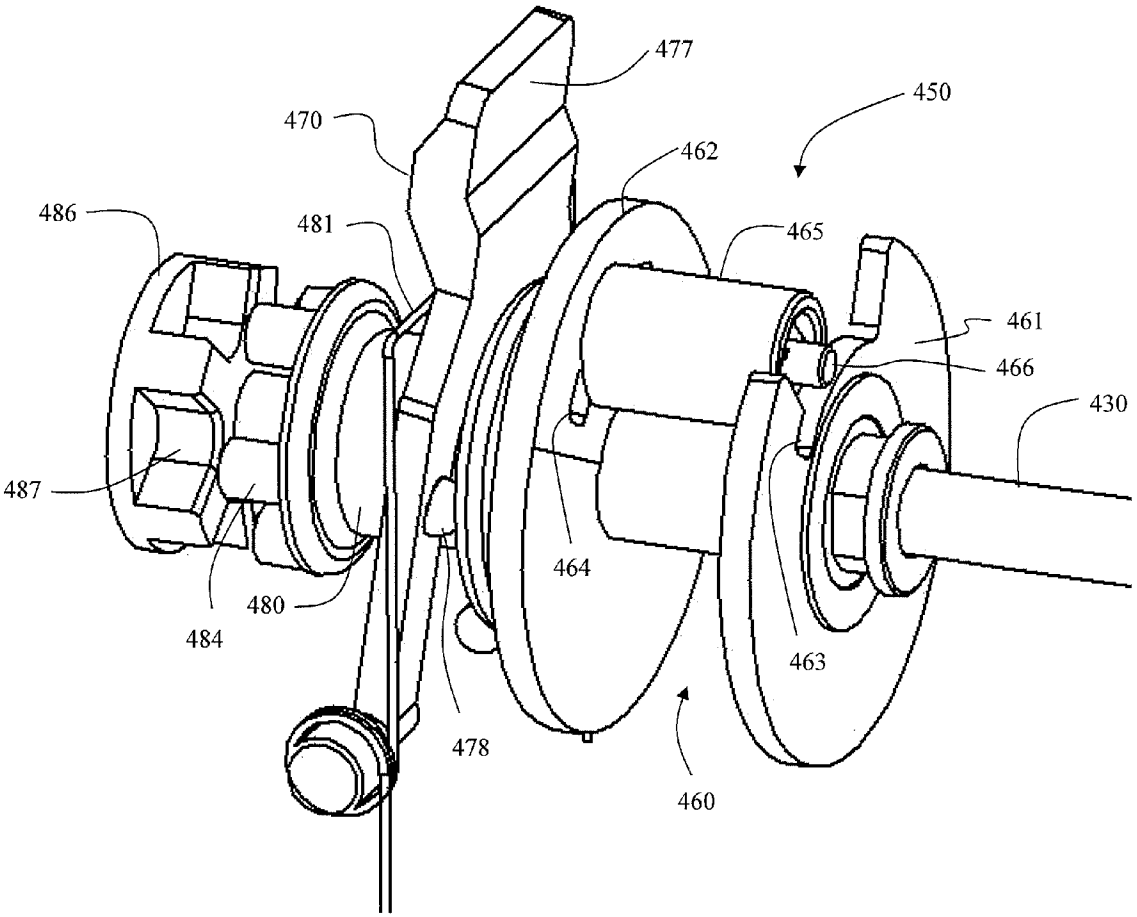
Figure 18:
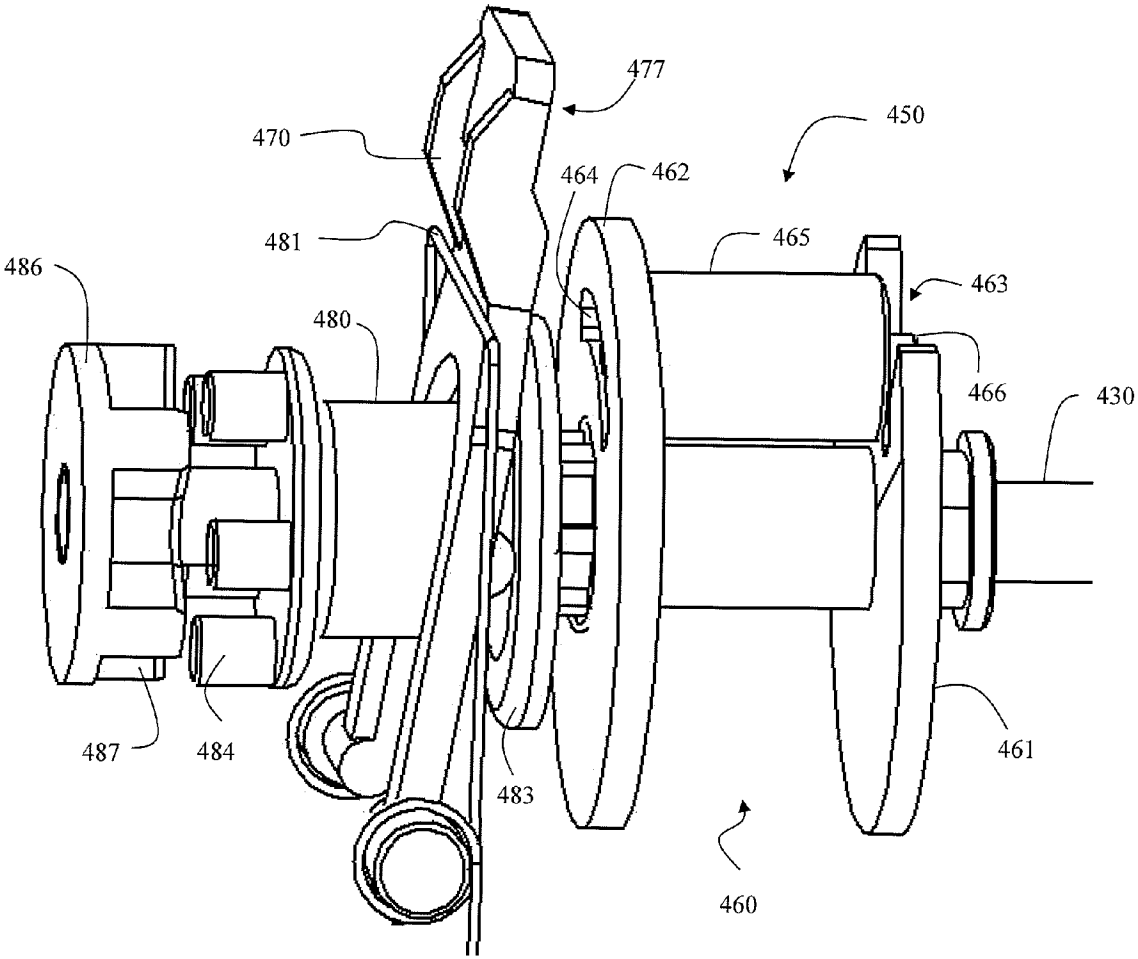
Figure 19:
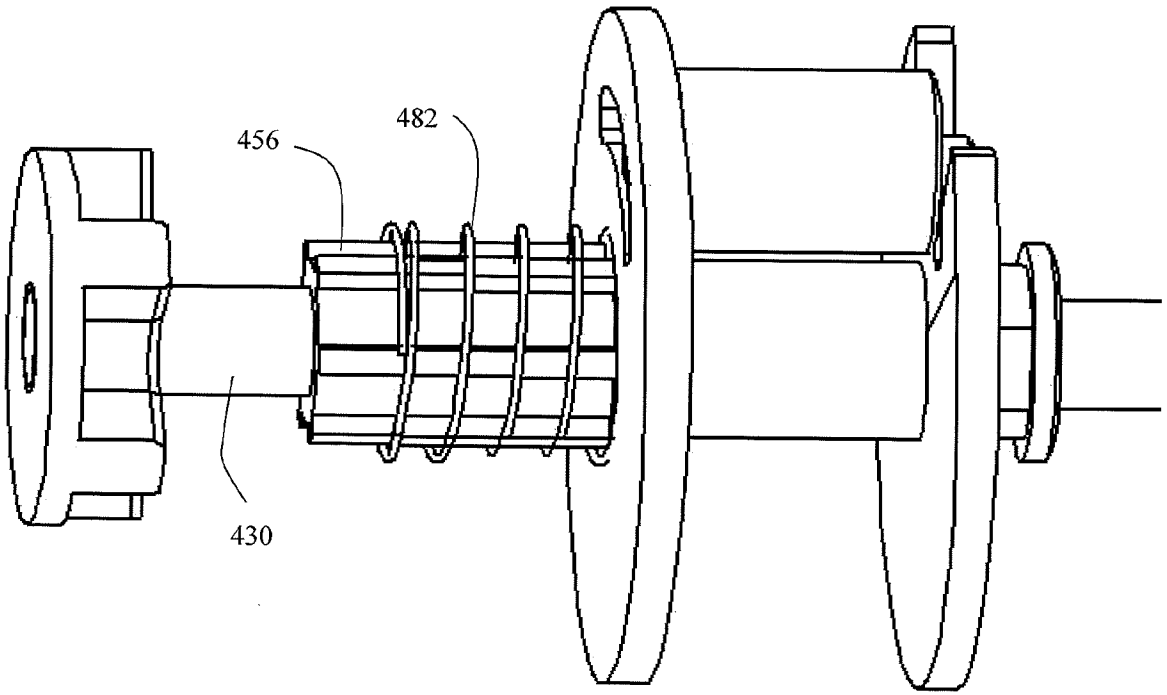

FIGS. 17 and 18 show the pump 450 and its engagement mechanisms from two different perspectives with the pump housing 452 removed for improved visibility. Parts and their relationships are as described above. FIG. 19 is similar to the perspective of FIG. 18, but with the slidable coupler 480 and the lever 470 removed so that the compression spring 482 is more readily seen in its coaxial mounting configuration around the pump coupling member 456 and the output roller shaft 430.

The invention has been described in detail with particular reference to certain preferred embodiments thereof, but it will be understood that variations and modifications can be effected within the scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
171 Pump roller
173 Pump roller cam
181 Droplet(s) (ejected from first nozzle array)
182 Droplet(s) (ejected from second nozzle array)
200 Carriage
249 Mounting substrate
250 Printhead
251 Printhead die (or ejector die)
253 Nozzle array
254 Nozzle array direction
256 Encapsulating material
257 Flex circuit
258 Connector board
262 Multi-chamber ink supply
264 Single-chamber ink supply
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
314 Shaft mount (for output roller)
315 Pivot arm
316 Hole
317 Feed roller pinion
318 Pivot arm gear
320 Pick-up roller
322 Turn roller
323 Idler roller
324 Output roller
325 Star wheel(s)
330 Maintenance station
332 Cap
333 drive shaft
334 Wiper
336 Pump
340 Toggle arm
344 First gear
346 Second gear
351 Compound gear
352 Compound gear
355 pump cam gear
370 Stack of media
371 Top piece of medium
380 Carriage motor
382 Carriage guide
383 Encoder fence
384 Belt (carriage)
390 Printer electronics board
392 Cable connectors
400 Printer chassis
405 Frame
406 Shaft mount (for output roller shaft)
407 Slot
408 pivot pin
410 media advance motor
412 Drive belt
414 Pulley and gear
416 Idler gear
420 Output roller gear
421 Drive member
422 Bushing
423 Outer face
424 Drive coupling member
425 Splines
426 Ends (of splines)
430 Output roller shaft
432 Output roller
434 Axis (of output roller shaft)
440 Slidable coupler
442 Grooves
444 First flange
445 Face (of first flange)
446 Second flange
448 Pin
450 Pump
451 Flexible tubing
452 Pump housing
453 Pump cover
454 Bracket
455 Hole (for bolt)
456 Pump coupling member
457 Splines
458 Ends (of splines)
459 Rib
460 Pump cam
461 First cam member
462 Second cam member
463 Curved slots

464 Curved slots
465 Pump roller
466 Pin
470 Lever
471 Torsional spring
472 First end
473 Second end
475 Opening (in lever)
476 Compression spring
477 Face (of lever)
478 Protuberances
480 Slidable coupler
481 Bent torsion spring
482 Compression spring
483 Flange
484 Projection
485 Face (of slidable coupler)
486 Shaft coupling member
487 Recess
490 Star wheel assembly

The invention claimed is:

1. An inkjet printer comprising:
a printhead;
a carriage for moving the printhead back and forth in a carriage scan direction across a printing region;
an output roller that is downstream of the printing region for moving recording medium away from the printing region, the output roller including a shaft;
a peristaltic pump that is coaxially disposed around the shaft of the output roller, the peristaltic pump including:
a housing;
a flexible tubing member;
a pump roller;
a pump cam for forcing the pump roller to move along the flexible tubing member while compressing the flexible tubing member; and
a pump coupling member extending from the pump cam, wherein the pump coupling member is coaxially disposed around the shaft of the output roller, and wherein the shaft of the output roller is configured to rotate independently of the pump coupling member;
a restraining lever that disconnects the pump from power when the carriage is not in contact with the restraining lever;
a media advance motor;
a shaft coupling member that is affixed to the shaft of the output roller; and
a slidable coupler that is configured to selectively link the pump coupling member to the shaft coupling member.

2. The inkjet printer of claim 1, the pump including a housing that is coaxially disposed around the shaft of the output roller without touching the shaft.

3. The inkjet printer of claim 1, wherein the slidable coupler is coaxially disposed around the shaft of the output roller and can be moved toward the shaft coupling member or moved away from the shaft coupling member.

4. The inkjet printer of claim 1, wherein the slidable coupler includes grooves, and wherein the pump coupling member includes splines that engage the grooves.

5. The inkjet printer of claim 1, wherein the slidable coupler includes projections extending from a face that is proximate the shaft coupling member, and wherein the shaft coupling member includes recesses that are configured to engage the projections.

6. The inkjet printer of claim 1 further comprising a spring that is configured to push the slidable coupler toward the shaft coupling member.

7. The inkjet printer of claim 6, wherein the restraining lever is configured to restrain the slidable coupler from engaging the shaft coupling member.

8. The inkjet printer of claim 6, wherein the spring is a first spring, further comprising a second spring that is configured to apply a force to push the slidable coupler away from the shaft coupling member.

9. The inkjet printer of claim 2 further comprising a frame for mounting the pump and the shaft of the output roller, the housing of the pump including a rib extending parallel to the carriage scan direction, wherein the rib is configured to align the housing relative to the shaft of the output roller.

10. An inkjet printer comprising:
an output roller that is downstream of a printing region for moving recording medium away from the printing region, the output roller including a shaft;
a peristaltic pump that is coaxially disposed around the shaft of the output roller, the peristaltic pump including:
a housing;
a flexible tubing member;
a pump roller;
a pump cam for forcing the pump roller to move along the flexible tubing member while compressing the flexible tubing member; and
a pump coupling member extending from the pump cam, wherein the pump coupling member is coaxially disposed around the shaft of the output roller, and wherein the shaft of the output roller is configured to rotate independently of the pump coupling member;
a media advance motor;
a drive member for transmitting rotational power from the media advance motor to the shaft of the output roller, wherein the drive member includes a drive coupling member that is coaxially disposed around the shaft of the output roller, and wherein rotation of the shaft of the output roller is not independent of rotation of the drive coupling member; and
a slidable coupler that is configured to selectively link the pump coupling member to the drive coupling member.

11. The inkjet printer of claim 10, wherein the slidable coupler coaxially disposed around the shaft of the output roller and can be moved toward the drive member to engage the drive coupling member or moved away from the drive member to disengage the drive coupling member.

12. The inkjet printer of claim 10, wherein the slidable coupler includes grooves, and wherein the pump coupling member and the drive coupling member include splines that are configured to engage the grooves.

13. The inkjet printer of claim 11 further comprising:
a printhead;
a carriage for moving the printhead back and forth across the printing region; and
an engagement lever for moving the slidable coupler toward the drive member to engage the drive coupling member with the slidable coupler when the carriage moves the engagement lever to a predetermined position.

14. The inkjet printer of claim 13 further comprising a pivot pin about which the engagement lever is configured to pivot, the engagement lever including:
a first end that is pivotably mounted on the pivot pin;
a second end opposite the first end, the second end disposed in a carriage motion path; and
an opening through which the slidable coupler extends, the opening disposed between the first end and the second end.

15. The inkjet printer of claim 14, the slidable coupler including a flange that faces the drive member, wherein the engagement lever is configured to push the flange toward the drive member when the carriage is in contact with the second end of the engagement lever.

16. The inkjet printer of claim 15 further comprising a spring that biases the slidable coupler out of engagement with the drive coupling member when the carriage is not in contact with the second end of the engagement lever.

17. The inkjet printer of claim 16, wherein the spring is a torsional spring that is coaxial with the pivot pin.

18. The inkjet printer of claim 17, wherein the flange is a first flange and the slidable coupler includes a second flange opposite the first flange, wherein the torsional spring biases the engagement lever to push the second flange away from the drive member when the carriage is not in contact with the second end of the engagement lever.

19. The inkjet printer of claim 10, wherein a bushing extends from an outer face of the drive member.

* * * * *